US010753543B2

(12) United States Patent
Nakamura et al.

(10) Patent No.: US 10,753,543 B2
(45) Date of Patent: Aug. 25, 2020

(54) STEAM TURBINE PIPE AND PIPE

(71) Applicants: TOSHIBA ENERGY SYSTEMS & SOLUTIONS CORPORATION, Kawasaki-shi (JP); TOSHIBA PLANT SYSTEMS & SERVICES CORPORATION, Yokohama-shi (JP)

(72) Inventors: Yuichi Nakamura, Yokohama (JP); Tomoo Ohfuji, Yokohama (JP); Tsutomu Shioyama, Yokohama (JP); Hiroki Shiraishi, Yokohama (JP); Makoto Takahashi, Yokohama (JP); Tsutomu Ooishi, Yokohama (JP); Daisuke Asakura, Kawasaki (JP); Toshihiko Endo, Yokohama (JP); Hiroyuki Tao, Kawasaki (JP); Tetsuya Yamanaka, Yokohama (JP); Koji Kanbe, Kawasaki (JP); Hiroyuki Nishi, Yokohama (JP)

(73) Assignees: TOSHIBA ENERGY SYSTEMS & SOLUTIONS CORPORATION, Kawasaki-shi (JP); TOSHIBA PLANT SYSTEMS & SERVICES CORPORATION, Yokohama-shi (JP)

( * ) Notice: Subject to any disclaimer, the term of this patent is extended or adjusted under 35 U.S.C. 154(b) by 3 days.

(21) Appl. No.: 16/223,398

(22) Filed: Dec. 18, 2018

(65) Prior Publication Data

US 2019/0120436 A1 Apr. 25, 2019

Related U.S. Application Data

(62) Division of application No. 14/256,153, filed on Apr. 18, 2014, now Pat. No. 10,203,069.

(30) Foreign Application Priority Data

Apr. 19, 2013 (JP) ..... 2013-088895

(51) Int. Cl.
*F17D 3/01* (2006.01)
*F01K 3/22* (2006.01)
(Continued)

(52) U.S. Cl.
CPC ..... *F17D 3/01* (2013.01); *F01K 3/22* (2013.01); *F01K 13/02* (2013.01); *F22B 37/50* (2013.01); *Y10T 137/877* (2015.04)

(58) Field of Classification Search
CPC ... F17D 3/01; F22B 37/50; F01K 3/22; F01K 13/02; F01K 9/04; F01D 19/00; F01D 19/02; F01D 25/10; Y10T 137/877
(Continued)

(56) References Cited

U.S. PATENT DOCUMENTS 4,053,746 A * 10/1977 Braytenbah ..... F01D 19/00 700/290
4,267,458 A 5/1981 Uram
(Continued)

FOREIGN PATENT DOCUMENTS

CN 101287892 A 10/2008
CN 201531703 U 7/2010
(Continued)

OTHER PUBLICATIONS

Extended European Search Report dated Oct. 29, 2014 in Patent Application No. 14164992.1.
(Continued)

*Primary Examiner* — Mark A Laurenzi
*Assistant Examiner* — Mickey H France
(74) *Attorney, Agent, or Firm* — Oblon, McClelland, Maier & Neustadt, L.L.P.

(57) ABSTRACT

A steam turbine pipe 1 of an embodiment includes: an upper half side main steam pipe 11 that leads steam to a steam turbine; an upper half side main steam control valve 30 that
(Continued)

intervenes in the upper half side main steam pipe 11; and a post-valve drain pipe 31 that is connected to the upper half side main steam control valve 30 and leads drain to an outside. The steam turbine pipe 1 further includes: a shut-off valve 32 that intervenes in the post-valve drain pipe 31; and a branching pipe 60 that makes the post-valve drain pipe 31 on the side closer to the upper half side main steam control valve 30 than is the shut-off valve 32 communicate with the upper half side main steam pipe 11 between the upper half side main steam control valve 30 and a high-pressure turbine 200.

5 Claims, 10 Drawing Sheets

(51) Int. Cl.
*F01K 13/02* (2006.01)
*F22B 37/50* (2006.01)

(58) Field of Classification Search
USPC ..... 60/646, 648, 652, 656, 657, 658, 670
See application file for complete search history.

(56) References Cited

U.S. PATENT DOCUMENTS

| | | | | |
|---|---|---|---|---|
| 4,576,008 | A * | 3/1986 | Silvestri, Jr. ..... | F01K 9/04 60/662 |
| 5,388,411 | A | 2/1995 | McKeever | |
| 6,966,769 | B2 | 11/2005 | Elvander et al. | |
| 7,765,807 | B2 * | 8/2010 | Diesterbeck ..... | F01D 25/10 60/645 |
| 2004/0013511 | A1 | 1/2004 | Brackenhammer et al. | |

FOREIGN PATENT DOCUMENTS

| | | | | |
|---|---|---|---|---|
| CN | 201650384 | U | | 11/2010 |
| CN | 201723258 | U | | 1/2011 |
| DE | 2 029 830 | A1 | | 12/1971 |
| JP | 60-222507 | A | | 11/1985 |
| JP | 3-003045 | | | 1/1991 |
| JP | 3-233112 | A | | 10/1991 |
| JP | 6-221107 | A | | 8/1994 |
| JP | 06221107 | A | * | 8/1994 |
| JP | 2007-232537 | A | | 9/2007 |
| JP | 2009-156215 | A | | 7/2009 |

OTHER PUBLICATIONS

Combined Office Action and Search Report dated Apr. 22, 2015 in Chinese Patent Application No. 201410152077.0 (with English Translation of Category of Cited Documents).

Xu-jie Wu, et al., "Modification of Drain Mode in High-Pressure Steam Conducting Pipe to Steam Turbines of Qinshan Nuclear Power Plant No. 3" China Academic Journal Electronic Publishing House, vol. 38, No. 7. Jul. 15, 2009, pp. 72-75 (with English Abstract).

Office Action dated Jan. 31, 2017 in Japanese Patent Application No. 2013-088895 (with unedited computer generated English translation).

* cited by examiner

STEAM TURBINE PIPE AND PIPE

CROSS REFERENCE TO RELATED APPLICATIONS

This application is a Divisional of U.S. application Ser. No. 14/256,153 filed Apr. 18. 2014, and is based upon and claims the benefit of priority from Japanese Patent Application No. 2013-088895, filed on Apr. 19, 2013; the entire contents of each of which are incorporated herein by reference.

FIELD

Embodiments described herein relate generally to a steam turbine pipe and a pipe.

BACKGROUND

In a steam turbine pipe system, a main steam pipe is provided which leads steam generated in a boiler to a steam turbine. The main steam pipe is provided with a main steam control valve for regulating the flow rate of the steam.

The main steam control valve is provided with a drain pipe that discharges drain generated in the main steam pipe on the downstream side of the main steam control valve when performing warming for operating the steam turbine. The drain pipe is provided with a shut-off valve, and the drain is led to a condenser by opening the shut-off valve. Then, the shut-off valve is closed after completion of the warming.

A typical steam turbine includes an upper half side main steam pipe and a lower half side main steam pipe so as to be able to lead the steam to the upper half side and the lower half side of the steam turbine, respectively. In addition, each of the main steam pipes is provided with a main steam control valve provided with a drain pipe as described above.

In the conventional steam turbine pipe system, a pressure fluctuation of steam on the downstream of the main steam control valve is influenced by the pipe design of the main steam pipe on the downstream side of the main steam control valve. For example, the upper half side main steam pipe is sometimes routed and arranged in a narrow space as compared with the lower half side main steam pipe. In this case, the pressure fluctuation of steam in the main steam pipe on the downstream of the main steam control valve is large in the upper half side main steam pipe and small in the lower half side main steam pipe in terms of the pipe design of the main steam pipe.

In the above-described drain pipe provided at the conventional upper half side main steam control valve, increasing the load up to a rated operation of the steam turbine in a state that the shut-off valve is closed sometimes abnormally increases the temperature of the drain pipe between the main steam control valve and the shut-off valve. Consequently, the abnormal increase in temperature may cause breakage of the drain pipe.

DETAILED DESCRIPTION

Hereinafter, embodiments of the present invention will be described with reference to the drawings.

First Embodiment

Figure 1:
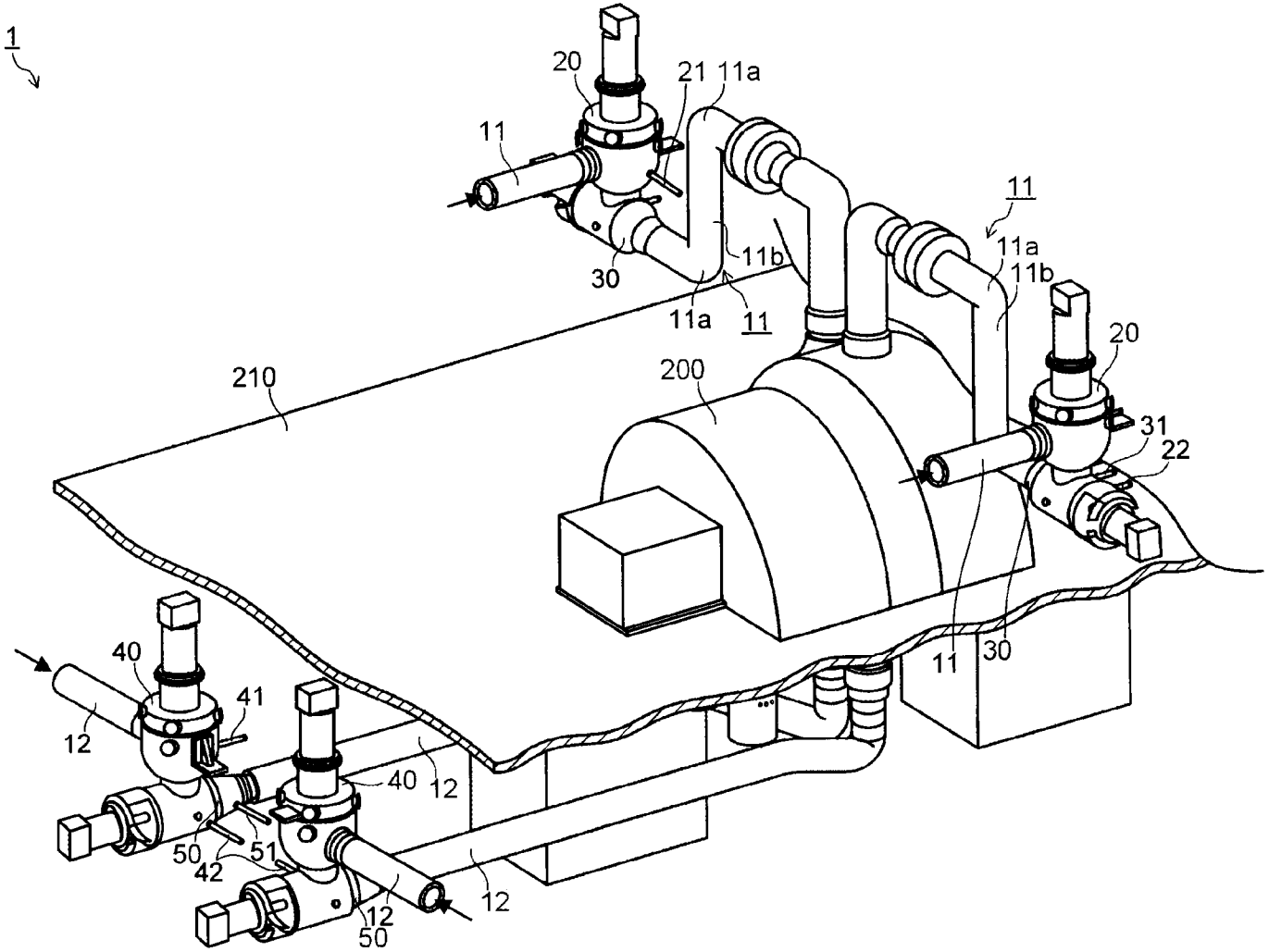
FIG. 1 is a perspective view illustrating a configuration of a steam turbine pipe of a first embodiment.
Figure 2:
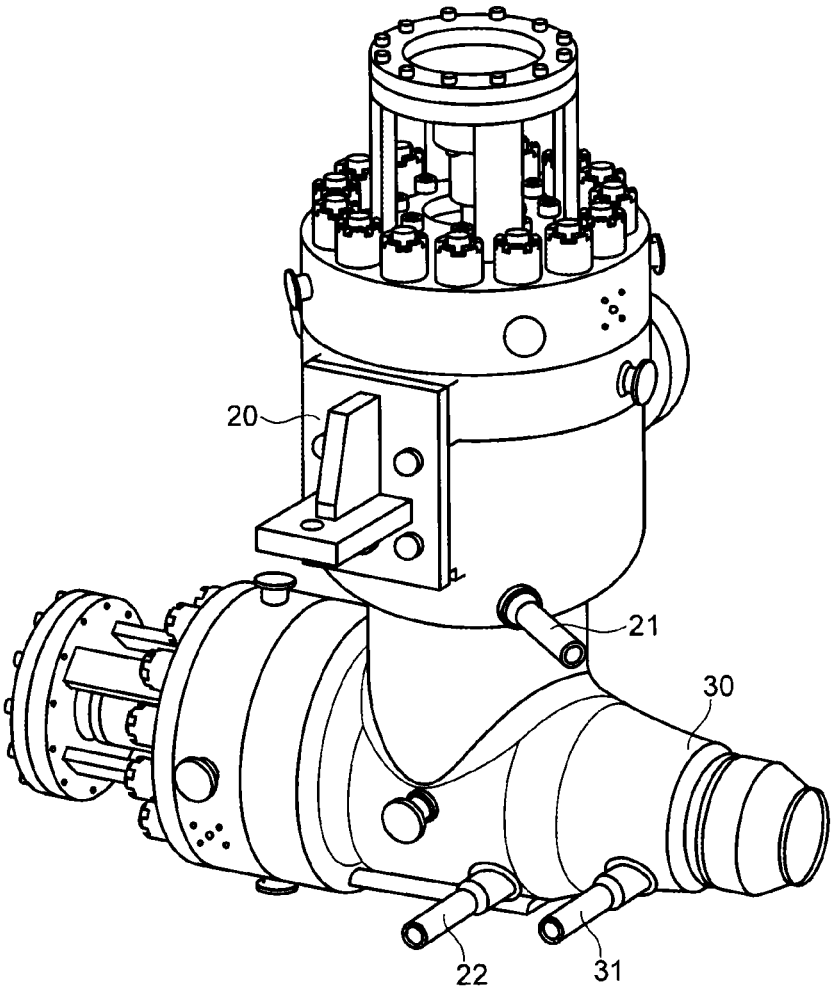
FIG. 2 is a view illustrating a perspective view of an upper half side main stop valve and an upper half side main steam control valve provided at the steam turbine pipe of the first embodiment.

FIG. 1 is a perspective view illustrating a configuration of a steam turbine pipe 1 of a first embodiment. FIG. 2 is a view illustrating a perspective view of an upper half side main stop valve 20 and an upper half side main steam control valve 30 provided at the steam turbine pipe 1 of the first embodiment.

As illustrated in FIG. 1, upper half side main steam pipes 11 and lower half side main steam pipes 12 are provided to be able to lead steam from a boiler to the upper half side and the lower half side of a high-pressure turbine 200. Here, an example where the upper half side main steam pipes 11 and the lower half side main steam pipes 12 are provided two each is illustrated.

The upper half side main stop valve 20 that shuts off the steam to be led to the high-pressure turbine 200 intervenes in the upper half side main steam pipe 11. Further, the upper half side main steam control valve 30 that regulates the flow rate of the steam to be led to the high-pressure turbine 200 intervenes on the downstream side of the upper half side main stop valve 20. Similarly to the upper half side main steam pipe 11, a lower half side main stop valve 40 that shuts off the steam to be led to the high-pressure turbine 200 intervenes in the lower half side main steam pipe 12. Further, a lower half side main steam control valve 50 that regulates the flow rate of the steam to be led to the high-pressure turbine 200 intervenes on the downstream side of the lower half side main stop valve 40.

FIG. 1 illustrates an example in which an upper half part side of the high-pressure turbine 200 and the upper half side main steam pipes 11 (including the upper half side main stop valves 20 and the upper half side main steam control valves 30) are provided on an upper floor and a lower half part side of the high-pressure turbine 200 and the lower half side main steam pipes 12 (including the lower half side main stop valves 40 and the lower half side main steam control valves 50) are provided on a lower floor via a floor part 210.

As illustrated in FIG. 1, the upper half side main steam pipe 11 on the downstream side of the upper half side main steam control valve 30 has, for example, a complicated pipe configuration having a straight pipe 11*b* between two elbow pipes 11*a* in order to make the steam turbine pipe 1 and a steam turbine building compact. On the other hand, the lower half side main steam pipe 12 on the downstream side of the lower half side main steam control valve 50 has, for example, a pipe configuration having a horizontal pipe as a main configuration.

The upper half side main stop valve 20 and the lower half side main stop valve 40 have the same configuration, and the upper half side main steam control valve 30 and the lower half side main steam control valve 50 have the same configuration. Hence, referring to the upper half side main stop valve 20 and the upper half side main steam control valve 30 illustrated in FIG. 2, drain pipes provided at them respectively will be described here.

As illustrated in FIG. 2, the upper half side main stop valve 20 is provided with a pre-valve drain pipe 21 for discharging drain on the upstream side of the valve, and a post-valve drain pipe 22 for discharging drain on the downstream side of the valve. The upper half side main steam control valve 30 is provided with a post-valve drain pipe 31 for discharging drain on the downstream side of the valve.

Note that in FIG. 1, a pre-valve drain pipe of the lower half side main stop valve 40 is indicated with a numeral 41, and a post-valve drain pipe of the lower half side main stop valve 40 is indicated with a numeral 42. Further, a post-valve drain pipe of the lower half side main steam control valve 50 is indicated with a numeral 51.

Each of the drain pipes is provided with a shut-off valve, and the end of each drain pipe communicates with, for example, a condenser. By opening the shut-off valve of each drain pipe, the drain is led to the steams condenser. The shut-off valve of each drain pipe is opened at warming of the high-pressure turbine 200. Then, the drain generated, for example, in the upper half side main steam pipe 11 and the lower half side main steam pipe 12 is led to the condenser. The shut-off valve of each drain pipe is closed after completion of the warming.

Next, a pipe configuration of the post-valve drain pipe 31 of the upper half side main steam control valve 30 in the steam turbine pipe 1 of the first embodiment will be described. Note that the pipe configuration of the post-valve drain pipe 31 of the upper half side main steam control valve 30 will be described here as an example. Note that this pipe configuration is also applicable to the pipe configuration of the post-valve drain pipe 51 of the lower half side main steam control valve 50.

(First Pipe Configuration)

Figure 3:
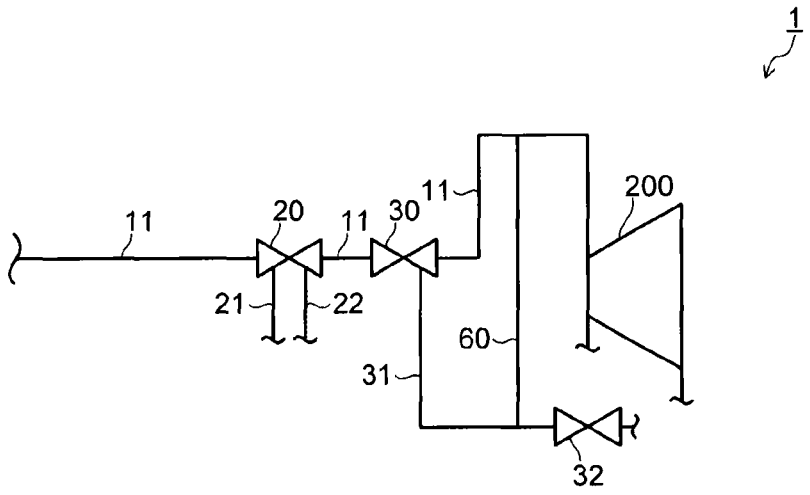
FIG. 3 is a diagram schematically illustrating a first pipe configuration of a post-valve drain pipe of the upper half side main steam control valve in the steam turbine pipe of the first embodiment.

FIG. 3 is a diagram schematically illustrating a first pipe configuration of the post-valve drain pipe 31 of the upper half side main steam control valve 30 in the steam turbine pipe 1 of the first embodiment.

The post-valve drain pipe 31 is provided with a shut-off valve 32. Further, in the first pipe configuration, a branching pipe 60 that branches off from the post-valve drain pipe 31, on the side closer to the upper half side main steam control valve 30 than is the shut-off valve 32, and has an open end as illustrated in FIG. 3. The open end of the branching pipe 60 is connected (coupled) to the upper half side main steam pipe 11 between the upper half side main steam control valve 30 and the high-pressure turbine 200. Namely, the branching pipe 60 makes the post-valve drain pipe 31 on the side closer to the upper half side main steam control valve 30 than is the shut-off valve 32 communicate with the upper half side main steam pipe 11 between the upper half side main steam control valve 30 and the high-pressure turbine 200.

After the shut-off valve 32 is closed, steam flows through the branching pipe 60 due to a differential pressure, for example, from the post-valve drain pipe 31 side to the upper half side main steam pipe 11 side.

Provision of the configuration ensures that the post-valve drain pipe 31 is provided with an open end between the upper half side main steam control valve 30 and the shut-off valve 32 even after the shut-off valve 32 is closed. Therefore, the post-valve drain pipe 31 between the upper half side main steam control valve 30 and the shut-off valve 32 does not only have the configuration in which one end is opened and the other end is closed. This makes it possible to suppress an abnormal increase in temperature of the post-valve drain pipe 31 between the upper half side main steam control valve 30 and the shut-off valve 32. Consequently, breakage of the post-valve drain pipe 31 can be prevented.

(Second Pipe Configuration)

Figure 4:
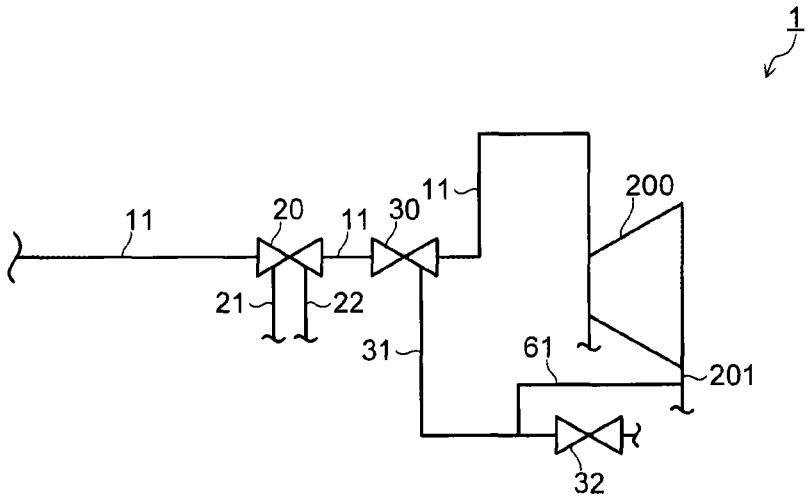
FIG. 4 is a diagram schematically illustrating a second pipe configuration of the post-valve drain pipe of the upper half side main steam control valve in the steam turbine pipe of the first embodiment.

FIG. 4 is a diagram schematically illustrating a second pipe configuration of the post-valve drain pipe 31 of the upper half side main steam control valve 30 in the steam turbine pipe 1 of the first embodiment. Note that component parts which are the same as those in the first pipe configuration are denoted by the same reference numerals, and overlapped description thereof will be omitted or simplified hereinafter.

In the second pipe configuration, a branching pipe 61 that branches off from the post-valve drain pipe 31, on the side closer to the upper half side main steam control valve 30 than is the shut-off valve 32, and has an open end as illustrated in FIG. 4. The open end of the branching pipe 61 is connected to an exhaust pipe 201 (for example, a low-temperature reheat steam pipe) that exhausts steam from the high-pressure turbine 200. Namely, the branching pipe 61 makes the post-valve drain pipe 31 on the side closer to the upper half side main steam control valve 30 than is the shut-off valve 32 communicate with the exhaust pipe 201.

After the shut-off valve 32 is closed, steam flows through the branching pipe 61 due to a differential pressure, for example, from the post-valve drain pipe 31 side to the exhaust pipe 201 side.

Provision of the configuration makes it possible to achieve the same operation and effect as those in the first pipe configuration.

Note that though one example in which the open end of the branching pipe 61 is connected to the exhaust pipe 201 is illustrated here, the branching pipe 61 is not limited to this configuration. The open end of the branching pipe 61 may be connected, for example, to an extraction steam pipe (not illustrated) that extracts steam from the high-pressure turbine 200. This configuration can also suppress an abnormal increase in temperature of the post-valve drain pipe 31 between the upper half side main steam control valve 30 and the shut-off valve 32 as in the above configuration. Consequently, breakage of the drain pipe can be prevented.

(Third Pipe Configuration)

Figure 5:
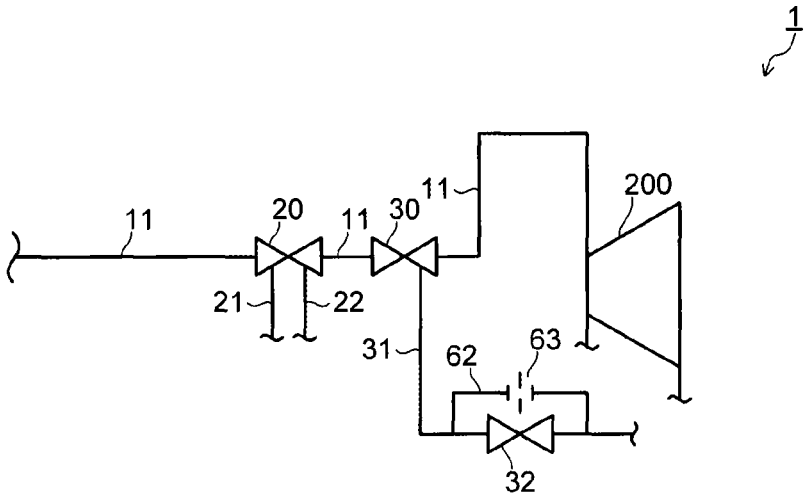
FIG. 5 is a diagram schematically illustrating a third pipe configuration of the post-valve drain pipe of the upper half side main steam control valve in the steam turbine pipe of the first embodiment.

FIG. 5 is a diagram schematically illustrating a third pipe configuration of the post-valve drain pipe 31 of the upper half side main steam control valve 30 in the steam turbine pipe 1 of the first embodiment.

In the third pipe configuration, a branching pipe 62 that branches off from the post-valve drain pipe 31, on the side closer to the upper half side main steam control valve 30 than is the shut-off valve 32, and has an open end as illustrated in FIG. 5. The open end of the branching pipe 62 is connected to the post-valve drain pipe 31 on the downstream side of the shut-off valve 32. Namely, the branching pipe 62 makes the post-valve drain pipe 31 on the side closer to the upper half side main steam control valve 30 than is the shut-off valve 32 communicate with the post-valve drain pipe 31 on the downstream side of the shut-off valve 32.

Even after the shut-off valve 32 is closed, steam flows through the branching pipe 62. Therefore, the branching pipe 62 is preferably provided, for example, with a narrowed portion 63 where a flow passage cross section is narrowed, in order to limit the flow rate of the steam flowing through the branching pipe 62.

Provision of the configuration makes it possible to achieve the same operation and effect as those in the first pipe configuration.

Second Embodiment

The configurations of an upper half side main steam pipe 11 provided with an upper half side main stop valve 20 and an upper half side main steam control valve 30 and a lower half side main steam pipe 12 provided with a lower half side main stop valve 40 and a lower half side main steam control valve 50 in a steam turbine pipe 2 of a second embodiment are the same as those in the steam turbine pipe 1 of the first embodiment.

In the steam turbine pipe 2 of the second embodiment, the pipe configuration of a post-valve drain pipe 31 of the upper half side main steam control valve 30, or the post-valve drain pipe 31 and a post-valve drain pipe 51 of the lower half side main steam control valve 50 is different from the pipe configuration of the first embodiment. Therefore, the different point will be mainly described.

(Fourth Pipe Configuration)

Figure 6:
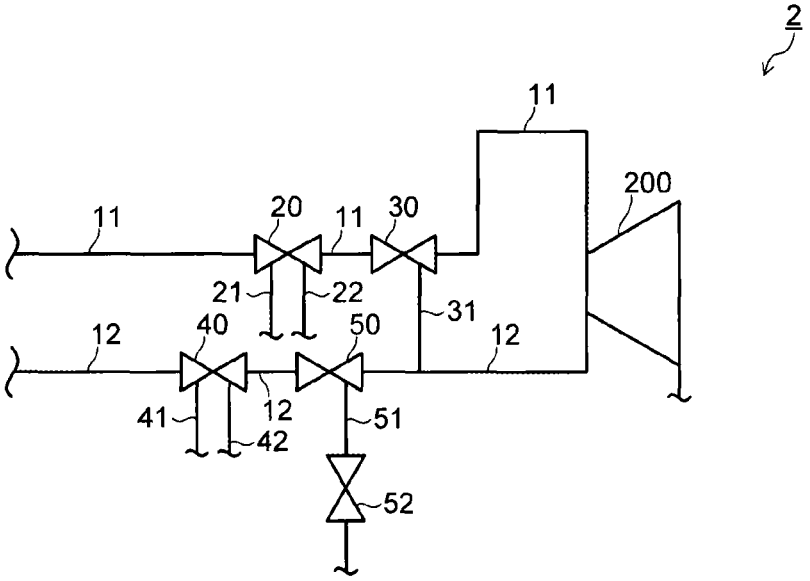
FIG. 6 is a diagram schematically illustrating a fourth pipe configuration of an upper half side main steam pipe and a lower half side main steam pipe in a steam turbine pipe of a second embodiment.

FIG. 6 is a diagram schematically illustrating a fourth pipe configuration of the upper half side main steam pipe 11 and the lower half side main steam pipe 12 in the steam turbine pipe 2 of the second embodiment.

The post-valve drain pipe 51 of the lower half side main steam control valve 50 is provided with a shut-off valve 52. Meanwhile, the post-valve drain pipe 31 of the upper half side main steam control valve 30 is not provided with a shut-off valve.

In the fourth pipe configuration, the post-valve drain pipe 31 connected to the upper half side main steam control valve 30 has an open end as illustrated in FIG. 6. The open end of the post-valve drain pipe 31 is connected to the lower half side main steam pipe 12 between the lower half side main steam control valve 50 and a high-pressure turbine 200. Namely, the post-valve drain pipe 31 makes the upper half side main steam control valve 30 communicate with the lower half side main steam pipe 12 on the downstream side of the lower half side main steam control valve 50.

Here, the open end of the post-valve drain pipe 31 is preferably connected at a portion, of the lower half side main steam pipe 12, which receives less influence by disturbance of the flow due to the throttle at the lower half side main steam control valve 50. Note that the post-valve drain pipe 31 functions as an upper half side drain pipe, and the post-valve drain pipe 51 functions as a lower half side drain pipe.

The end of the post-valve drain pipe 51 communicates with, for example, a condenser. The shut-off valve 52 is opened at warming of the high-pressure turbine 200. In this event, the drain generated in the upper half side main steam pipe 11 on the downstream side of the upper half side main steam control valve 30 is led to the lower half side main steam pipe 12 via the post-valve drain pipe 31. Then, the drain led to the lower half side main steam pipe 12 is led together with the drain generated in the lower half side main steam pipe 12 on the downstream side of the lower half side main steam control valve 50 to the condenser via the post-valve drain pipe 51. The shut-off valve 52 is closed after completion of the warming.

After the shut-off valve 52 is closed, steam flows through the post-valve drain pipe 31 due to a differential pressure, for example, from the upper half side main steam control valve 30 side to the lower half side main steam pipe 12 side.

Provision of the configuration ensures that the post-valve drain pipe 31 is provided with an open end even after the shut-off valve 52 is closed. Therefore, the post-valve drain pipe 31 does not have the configuration in which one end is opened and the other end is closed. This makes it possible to suppress an abnormal increase in temperature of the post-valve drain pipe 31. Consequently, breakage of the post-valve drain pipe 31 can be prevented.

Figure 7:
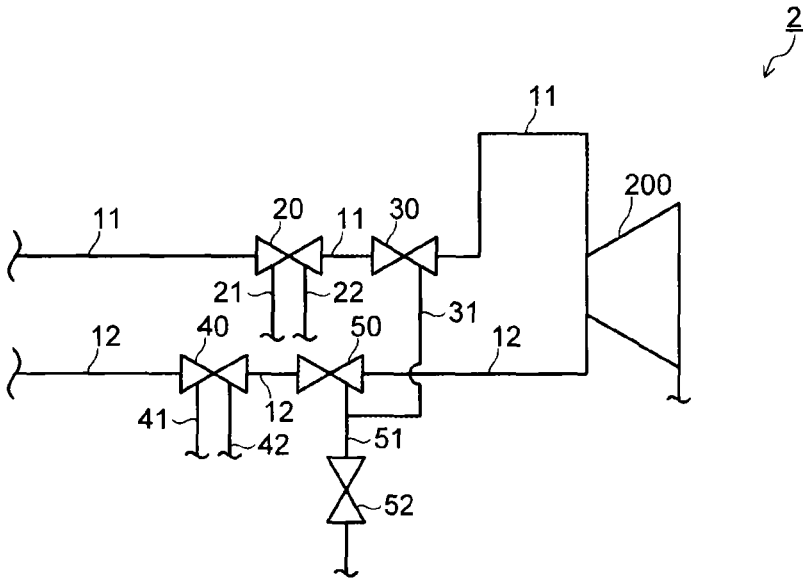
FIG. 7 is a diagram schematically illustrating another different configuration in the fourth pipe configuration of the upper half side main steam pipe and the lower half side main steam pipe in the steam turbine pipe of the second embodiment.

Note that though one example in which the open end of the post-valve drain pipe 31 is connected to the lower half side main steam pipe 12 on the downstream side of the lower half side main steam control valve 50 is illustrated here, the post-valve drain pipe 31 is not limited to this configuration. FIG. 7 is a diagram schematically illustrating another different configuration in the fourth pipe configuration of the upper half side main steam pipe 11 and the lower half side main steam pipe 12 in the steam turbine pipe 2 of the second embodiment.

As illustrated in FIG. 7, the open end of the post-valve drain pipe 31 may be connected to the post-valve drain pipe 51 between the lower half side main steam control valve 50 and the shut-off valve 52. Namely, the post-valve drain pipe 31 may be configured to make the upper half side main steam control valve 30 communicate with the post-valve drain pipe 51 between the lower half side main steam control valve 50 and the shut-off valve 52. Even this configuration can suppress an abnormal increase in temperature of the post-valve drain pipe 31 as in the above configurations. Consequently, breakage of the post-valve drain pipe 31 can be prevented.

(Fifth Pipe Configuration)

Figure 8:
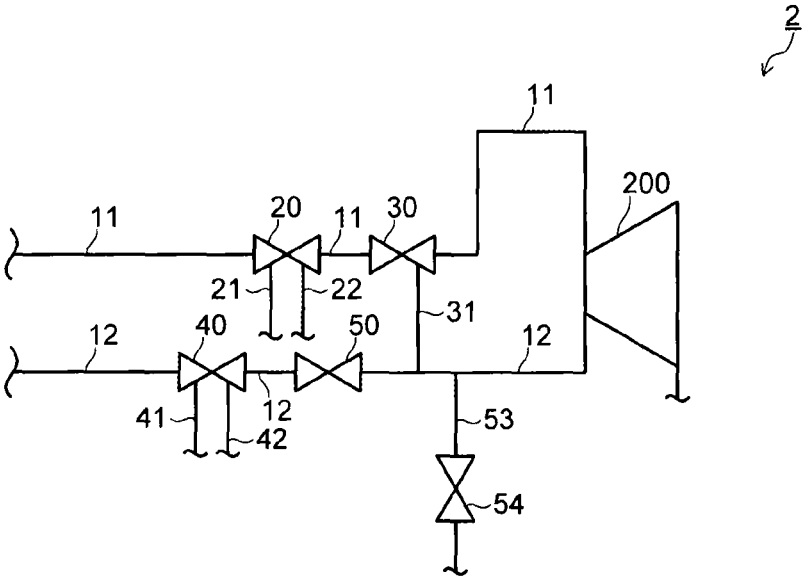
FIG. 8 is a diagram schematically illustrating a fifth pipe configuration of the upper half side main steam pipe and the lower half side main steam pipe in the steam turbine pipe of the second embodiment.

FIG. 8 is a diagram schematically illustrating a fifth pipe configuration of the upper half side main steam pipe 11 and the lower half side main steam pipe 12 in the steam turbine pipe 2 of the second embodiment.

As illustrated in FIG. 8, the post-valve drain pipe 31 of the upper half side main steam control valve 30 is not provided with a shut-off valve. The lower half side main steam control valve 50 is not provided with a drain pipe.

In the fifth pipe configuration, a lower half side drain pipe 53 that leads drain to the outside is provided at the lower half side main steam pipe 12 between the lower half side main steam control valve 50 and the high-pressure turbine 200. The lower half side drain pipe 53 is provided with a shut-off valve 54. The end of the lower half side drain pipe 53 communicates with, for example, the condenser.

The post-valve drain pipe 31 connected to the upper half side main steam control valve 30 has an open end. The open end of the post-valve drain pipe 31 is connected to the lower half side main steam pipe 12 between the lower half side main steam control valve 50 and the lower half side drain pipe 53. Namely, the post-valve drain pipe 31 makes the upper half side main steam control valve 30 communicate with the lower half side main steam pipe 12 between the lower half side main steam control valve 50 and the lower half side drain pipe 53. Note that the open end of the post-valve drain pipe 31 may be connected to the lower half side main steam pipe 12 at a position on the downstream side of a portion to which the lower half side drain pipe 53 is connected.

Here, the open end of the post-valve drain pipe 31 and one end of the lower half side drain pipe 53 are preferably connected at portions, of the lower half side main steam pipe 12, which receive less influence by disturbance of the flow due to the throttle at the lower half side main steam control valve 50. Note that the post-valve drain pipe 31 functions as an upper half side drain pipe.

The shut-off valve 54 is opened at warming of the high-pressure turbine 200. In this event, the drain generated in the upper half side main steam pipe 11 on the downstream side of the upper half side main steam control valve 30 is led to the lower half side main steam pipe 12 via the post-valve drain pipe 31. Then, the drain led to the lower half side main steam pipe 12 is led together with the drain generated in the lower half side main steam pipe 12 on the downstream side of the lower half side main steam control valve 50 to the condenser via the lower half side drain pipe 53. The shut-off valve 54 is closed after completion of the warming.

After the shut-off valve 54 is closed, steam flows through the post-valve drain pipe 31 due to a differential pressure, for example, from the upper half side main steam control valve 30 side to the lower half side main steam pipe 12 side.

Provision of the configuration ensures that the post-valve drain pipe 31 is provided with an open end even after the shut-off valve 54 is closed. Therefore, the same operation and effect as those in the fourth pipe configuration can be achieved.

Figure 9:
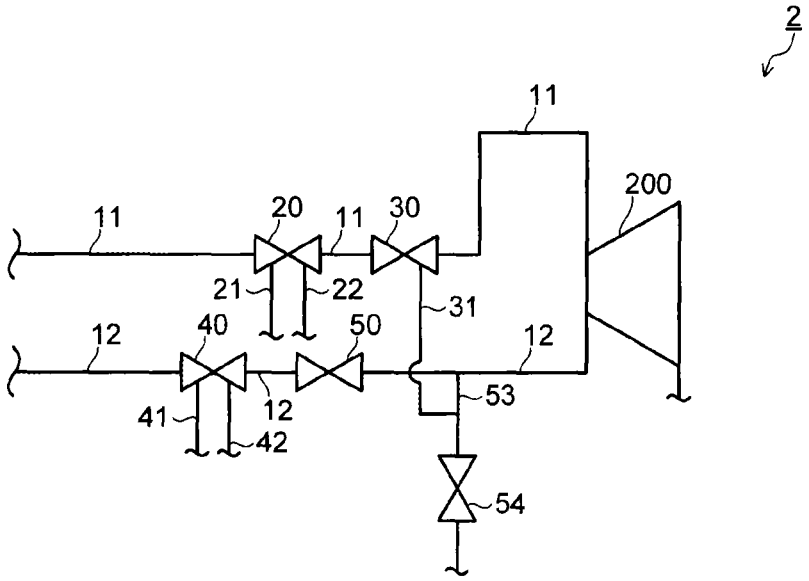
FIG. 9 is a diagram schematically illustrating another different configuration in the fifth pipe configuration of the upper half side main steam pipe and the lower half side main steam pipe in the steam turbine pipe of the second embodiment.

Note that though one example in which the open end of the post-valve drain pipe 31 is connected to the lower half side main steam pipe 12 between the lower half side main steam control valve 50 and the lower half side drain pipe 53 is illustrated here, the post-valve drain pipe 31 is not limited to this configuration. FIG. 9 is a diagram schematically illustrating another different configuration in the fifth pipe configuration of the upper half side main steam pipe 11 and the lower half side main steam pipe 12 in the steam turbine pipe 2 of the second embodiment.

As illustrated in FIG. 9, the open end of the post-valve drain pipe 31 may be connected to the lower half side drain pipe 53 between the lower half side main steam pipe 12 and the shut-off valve 54. Namely, the post-valve drain pipe 31 may be configured to make the upper half side main steam control valve 30 communicate with the lower half side drain pipe 53 between the lower half side main steam pipe 12 and the shut-off valve 54. Even this configuration can suppress an abnormal increase in temperature of the post-valve drain pipe 31 as in the above configurations. Consequently, breakage of the post-valve drain pipe 31 can be prevented.

Third Embodiment

The configurations of an upper half side main steam pipe 11 provided with an upper half side main stop valve 20 and an upper half side main steam control valve 30 and a lower half side main steam pipe 12 provided with a lower half side main stop valve 40 and a lower half side main steam control valve 50 in a steam turbine pipe 3 of a third embodiment are the same as those in the steam turbine pipe 1 of the first embodiment.

In the steam turbine pipe 3 of the third embodiment, the pipe configuration of a post-valve drain pipe 31 of the upper half side main steam control valve 30 is different from the pipe configuration of the first embodiment. Therefore, the different point will be mainly described. Note that the pipe configuration of the post-valve drain pipe 31 of the upper half side main steam control valve 30 will be described here as an example. Note that this pipe configuration is also applicable to a pipe configuration of a post-valve drain pipe 51 of the lower half side main steam control valve 50.

Figure 10:
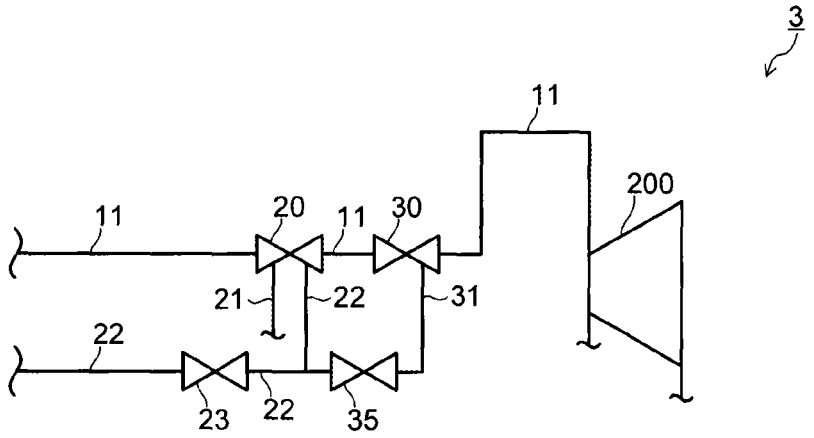
FIG. 10 is a diagram schematically illustrating a pipe configuration of a post-valve drain pipe of an upper half side main steam control valve in a steam turbine pipe of a third embodiment.

FIG. 10 is a diagram schematically illustrating a pipe configuration of the post-valve drain pipe 31 of the upper half side main steam control valve 30 in the steam turbine pipe 3 of the third embodiment.

As illustrated in FIG. 10, a post-valve drain pipe 22 of the upper half side main stop valve 20 is provided with a shut-off valve 23.

The post-valve drain pipe 31 has one end connected to the upper half side main steam control valve 30 and the other end connected to the post-valve drain pipe 22 between the shut-off valve 23 and the upper half side main stop valve 20. The post-valve drain pipe 31 is further provided with a shut-off valve 35. In the state where the shut-off valve 35 is opened, the post-valve drain pipe 31 makes the upper half side main steam control valve 30 communicate with the post-valve drain pipe 22 between the shut-off valve 23 and the upper half side main stop valve 20. Note that the post-valve drain pipe 22 functions as a first drain pipe, and the post-valve drain pipe 31 functions as a second drain pipe.

Here, the shut-off valve 35 is in an open state at the warming and at the time when the upper half side main steam control valve 30 is opened. When the upper half side main steam control valve 30 is closed (fully closed time) with the upper half side main stop valve 20 opened, the shut-off valve 35 is closed concurrently therewith and fully closed. This prevents steam from flowing to the high-pressure turbine 200 via the post-valve drain pipe 22 and the post-valve drain pipe 31.

The end of the post-valve drain pipe 22 communicates with, for example, a condenser. The shut-off valve 23 is opened at warming of the high-pressure turbine 200. In this event, the drain generated in the upper half side main steam pipe 11 on the downstream side of the upper half side main steam control valve 30 is led to the post-valve drain pipe 22 via the post-valve drain pipe 31. Then, the drain led to the post-valve drain pipe 22 is led together with the drain from the upper half side main stop valve 20 to the condenser. The shut-off valve 23 is closed after completion of the warming.

After the shut-off valve 23 is closed, steam flows through the post-valve drain pipe 31 due to a differential pressure, for example, from the side of the connecting portion with the post-valve drain pipe 22 to the upper half side main steam control valve 30 side.

Provision of the configuration ensures that the post-valve drain pipe 31 is provided with an open end even after the shut-off valve 23 is closed. Therefore, the post-valve drain pipe 31 does not have the configuration in which one end is opened and the other end is closed. This makes it possible to suppress an abnormal increase in temperature of the post-valve drain pipe 31. Consequently, breakage of the post-valve drain pipe 31 can be prevented.

(Explanation Relating to Suppression of Increase in Temperature of the Post-Valve Drain Pipe 31 in the First to Third Embodiments)

As described above, in the first embodiment, provision of the open end at the post-valve drain pipe 31 between the upper half side main steam control valve 30 and the shut-off valve 32 can suppress an abnormal increase in temperature of the post-valve drain pipe 31 between the upper half side main steam control valve 30 and the shut-off valve 32. Consequently, breakage of the post-valve drain pipe 31 can be prevented. As described above, in the second and third embodiments, provision of the open end at the post-valve drain pipe 31 can suppress an abnormal increase in temperature of the post-valve drain pipe 31. Consequently, breakage of the post-valve drain pipe 31 can be prevented.

Here, the reason why the provision of the open end at the post-valve drain pipe 31 can suppress an abnormal increase in temperature of the post-valve drain pipe 31 will be described.

(1) Explanation of Heat Generation Due to Pressure Fluctuation in the Pipe (Thermoacoustic Effect)

Here, it is assumed that the frequency of the pipe pressure fluctuation of a cylinder with an inside diameter of R is f (Hz). According to the document (Arakawa, Kawahashi, Transaction of the Society of Mechanical Engineers, Vol. 62 No. 598, B (1996), pp. 2238-2245), a heat flux q ($W/m^2$) generated by the thermoacoustic effect due to the pressure fluctuation in a boundary layer near a pipe wall can be obtained by the relation of Expression (1) made by dividing a pipe pressure fluctuation amplitude P by a pipe average pressure $P_0$ and making the quotient dimensionless, can be obtained by Expression (2).

[Mathematical Expression 1]

$$P_1 = P/P_0 \qquad \text{Expression (1)}$$

[Mathematical Expression 2]

$$q = K \times \left(\frac{1}{\gamma}\right)^2 \left(\frac{\mu a^2}{\delta/5}\right) P_1^2 \qquad \text{Expression (2)}$$

Here, $P_1$ is a dimensionless pressure amplitude, K is a constant, $\gamma$ is a specific heat ratio, $\mu$ is a viscosity coefficient, a is an acoustic velocity, $\delta$ is a thickness of the boundary layer, and R is an inside diameter of the cylinder.

Since the inner perimeter of the cylinder is $\pi R$, a heating value Q (W/m) per unit length of the cylinder is obtained by Expression (3).

[Mathematical Expression 3]

$$Q = K \times \left(\frac{1}{\gamma}\right)^2 \left(\frac{\mu a^2}{\delta/5}\right) P_1^2 \pi R \qquad \text{Expression (3)}$$

Assuming here that an angular frequency $\omega$ is $2\pi f$, the thickness $\delta$ of the boundary layer is obtained by Expression (4).

[Mathematical Expression 4]

$$\delta = 5\sqrt{\frac{\nu}{\omega}} \qquad \text{Expression (4)}$$

Here, $\nu$ is a kinematic viscosity coefficient.

Figure 11:
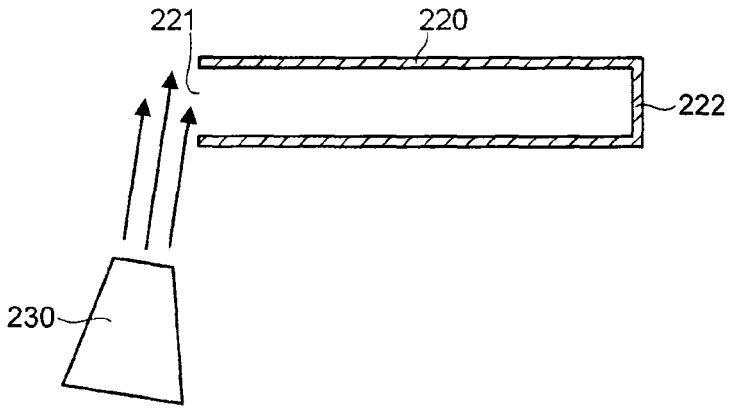
FIG. 11 is a view schematically illustrating a cross section of a pipe and a nozzle that generates a jet flow, for explaining that a pipe wall temperature increases when the pipe end is a closed end.
Figure 12:
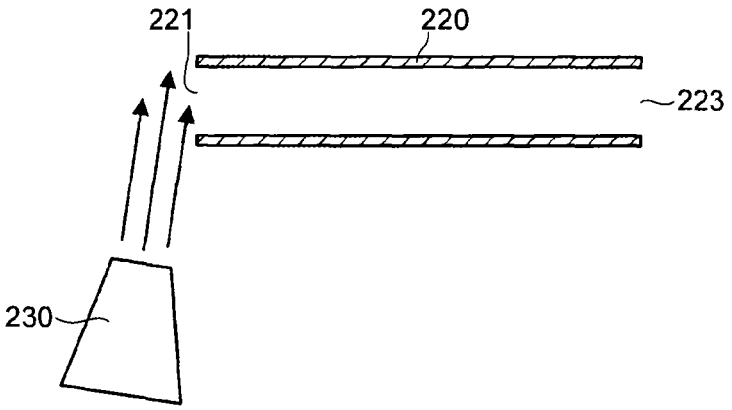
FIG. 12 is a view schematically illustrating a cross section of the pipe and the nozzle that generates a jet flow, for explaining that the pipe wall temperature does not increase when the pipe end is an open end.

(2) Explanation that the Pipe Wall Temperature Increases when the Pipe End is a Closed End, Whereas the Pipe Wall Temperature does not Increase when the Pipe End is an Open End FIG. 11 is a view schematically illustrating a cross section of a pipe 220 and a nozzle 230 that generates a jet flow, for explaining that the pipe wall temperature increases when the pipe end is a closed end 222. FIG. 12 is a view schematically illustrating a cross section of the pipe 220 and the nozzle 230 that generates a jet flow, for explaining that the pipe wall temperature does not increase when the pipe end is an open end 223.

In the case where the jet flow from the nozzle 230 collides with an opening 221 at one end of the pipe 220, a large pressure fluctuation occurs inside the pipe 220. Then, the pipe 220 is heated by the thermoacoustic effect as described in the above (1).

Assuming that the pipe wall temperature of the pipe 220 is T, a heating value Q (W/m) per unit length of the pipe 220 by the thermoacoustic effect is obtained by Expression (5).

[Mathematical Expression 5]

$$\left(Q - c_f \rho_f A_f v \frac{\partial \theta}{\partial x}\right) = c\rho A \frac{\partial T}{\partial t} + hD(T - T_\infty) - \lambda A \frac{\partial^2 T}{\partial x^2} \qquad \text{Expression (5)}$$

Here, c is a specific heat of the material of the pipe 220, p is a density of the material of the pipe 220, and $\lambda$ is a thermal conductivity of the material of the pipe 220. Further, A is a cross-sectional area of the pipe 220, h is a natural convection heat transfer coefficient of the pipe 220 to the surroundings, D is a perimeter of the pipe 220, and $T_\infty$ is an ambient temperature. Further, v is an average flow velocity of the flow inside the pipe 220, $\theta$ is a temperature of the fluid in the pipe 220, $c_f$ is a specific heat of the fluid in the pipe 220, $\rho_f$ is a density of the fluid in the pipe 220, $A_f$ is a cross-sectional area of a flow passage in the pipe 220, and x is coordinates in an axial direction of the pipe 220.

If the other end is the closed end 222, no flow occurs in the pipe 220. Therefore, v in Expression (5) is "0" and Expression (5) becomes Expression (6).

[Mathematical Expression 6]

$$Q = c\rho A\frac{\partial T}{\partial t} + hD(T - T_\infty) - \lambda A\frac{\partial^2 T}{\partial x^2} \quad \text{Expression (6)}$$

Here, in the case where the pipe 220 is kept warm with a heat insulating material and is a steel pipe with a low thermal conductivity, it is possible to omit the second term and the third term in the right side of Expression (6) to achieve approximation indicated in Expression (7).

[Mathematical Expression 7]

$$\frac{\partial T}{\partial t} \approx \frac{Q}{c\rho A} \quad \text{Expression (7)}$$

On the other hand, if the other end is the open end 223, a flow occurs in the pipe 220. Here, in the case where the pipe 220 is kept warm with a heat insulating material and is a steel pipe with a low thermal conductivity, it is possible to omit the second term and the third term in the right side of Expression (5) to achieve approximation indicated in Expression (8).

[Mathematical Expression 8]

$$\frac{\partial T}{\partial t} \approx \frac{1}{c\rho A}\left(Q - c_f\rho_f A_f v\frac{\partial \theta}{\partial x}\right) \quad \text{Expression (8)}$$

It is possible to approximate that the temperature of the fluid in the pipe 220 is substantially equal to the wall temperature T of the pipe 220. Further, when the relation of Expression (9) is satisfied in Expression (8), the cooling effect by the flow in the pipe 220 exceeds the heating effect by the thermoacoustic effect to decrease the pipe wall temperature T.

[Mathematical Expression 9]

$$Q < c_f\rho_f A_f v\frac{\partial \theta}{\partial x} \quad \text{Expression (9)}$$

Figure 13:
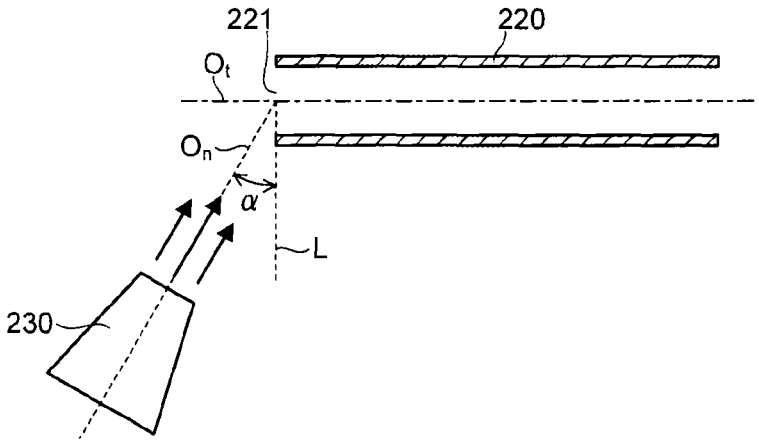
FIG. 13 is a view schematically illustrating a test device.

Here, the pipe wall temperature when the pipe end is the closed end or the open end was measured. FIG. 13 is a view schematically illustrating a test device. Note that FIG. 13 illustrates a state where the pipe end of the pipe 220 is the open end.

In the measurement, a pipe 220 was used which was made of stainless steel with a length of 360 mm, an inside diameter of 10 mm, and an outside diameter of 12 mm. An angle α formed between a straight line L perpendicular to a center axis $O_t$ of the pipe 220 and a center axis $O_n$ of the nozzle 230 at the opening 221 of the pipe 220 was set to 80 degrees. In air atmosphere (about 10° C.), air at the same temperature as the air atmosphere was jetted from the nozzle 230. A ratio between a pressure $P_n$ at the immediately upstream of a jet port of the nozzle 230 and an atmospheric pressure $P_a$ ($P_a/P_n$) was set to 0.44.

The outer wall temperature of the pipe 220 at the center position in the axial direction of the pipe 220 was measured by a thermocouple. Then, the measured temperature was regarded as the pipe wall temperature. When the other end of the pipe 220 was the closed end, the other end was closed with a lid.

Figure 14:
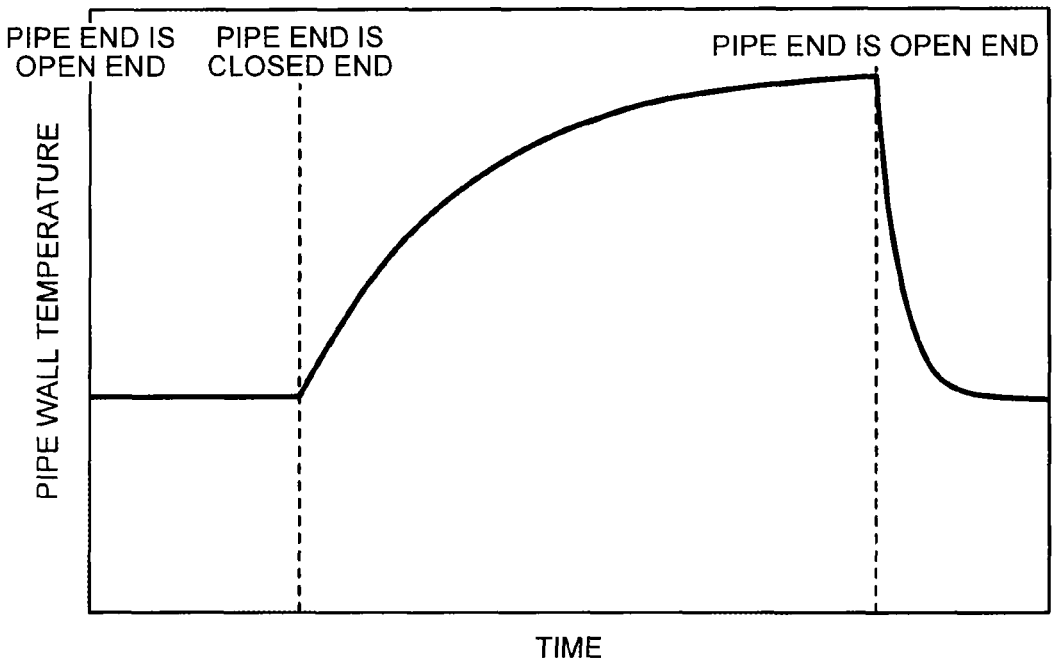
FIG. 14 is graph illustrating a result of measured pipe wall temperature when the pipe end was the closed end or the open end.

FIG. 14 is a graph illustrating the result of measured pipe wall temperature when the pipe end was the closed end or the open end. The measurement result at the time when the measurement was carried out while changing the pipe end state from the open end to the closed end and then again to the open end with the jet from the nozzle 230 colliding with the one end of the pipe, is illustrated.

As illustrated in FIG. 14, it is found that the pipe wall temperature increased only when the pipe end was the closed end. It is also found that when the pipe end state was changed from the closed end to the open end, the pipe wall was rapidly cooled. These phenomena coincide with the evaluation in each of the above-described expressions. In other words, it is found that when the pipe end is the open end, the pipe wall temperature does not increase.

The result shows that provision of the open end at the post-valve drain pipe 31 can suppress an abnormal increase in temperature of the post-valve drain pipe 31.

Fourth Embodiment

The configurations of an upper half side main steam pipe 11 provided with an upper half side main stop valve 20 and an upper half side main steam control valve 30 and a lower half side main steam pipe 12 provided with a lower half side main stop valve 40 and a lower half side main steam control valve 50 in a steam turbine pipe 4 of a fourth embodiment are the same as those in the steam turbine pipe 1 of the first embodiment.

In the steam turbine pipe 4 of the fourth embodiment, the pipe configuration of a post-valve drain pipe 31 of the upper half side main steam control valve 30 is different from the pipe configuration of the first embodiment. Therefore, the different point will be mainly described. Note that the pipe configuration of the post-valve drain pipe 31 of the upper half side main steam control valve 30 will be described here as an example. Note that this pipe configuration is also applicable to the pipe configuration of a post-valve drain pipe 51 of the lower half side main steam control valve 50.

(Sixth Pipe Configuration)

Figure 15:
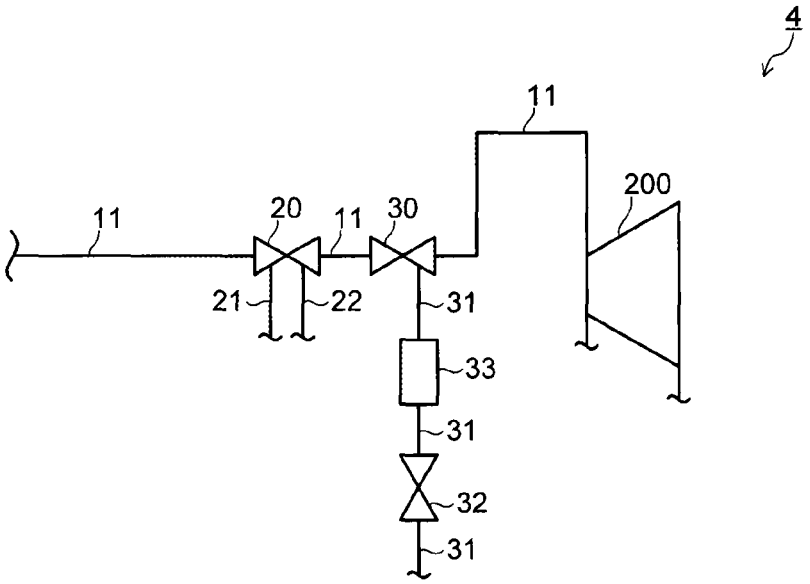
FIG. 15 is a diagram schematically illustrating a sixth pipe configuration of a post-valve drain pipe of an upper half side main steam control valve in a steam turbine pipe of a fourth embodiment.

FIG. 15 is a diagram schematically illustrating a sixth pipe configuration of the post-valve drain pipe 31 of the upper half side main steam control valve 30 in the steam turbine pipe 4 of the fourth embodiment.

The post-valve drain pipe 31 is provided with a shut-off valve 32. Further, an expanded portion 33 is provided at the post-valve drain pipe 31 between the upper half side main steam control valve 30 and the shut-off valve 32 as illustrated in FIG. 15. The expanded portion 33 has a space made by expanding the flow passage cross section of the post-valve drain pipe 31 and providing the expansion over a predetermined distance in the axial direction of the post-valve drain pipe 31. Namely, the expanded portion 33 is configured by providing the space, made by expanding the flow passage cross section of the post-valve drain pipe 31, at a part of the post-valve drain pipe 31 between the upper half side main steam control valve 30 and the shut-off valve 32.

Provision of the expanded portion 33 as described above makes it possible to suppress occurrence of resonant vibration in the post-valve drain pipe 31 between the upper half side main steam control valve 30 and the shut-off valve 32. This makes it possible to suppress an abnormal increase in temperature of the post-valve drain pipe 31 even after the shut-off valve 32 is closed. Consequently, breakage of the post-valve drain pipe 31 can be prevented.

Note that the above-described configuration is not limited to be provided at the post-valve drain pipe 31. For instance, the above-described configuration may be applied to a branching pipe that branches off from a steam path leading steam from the boiler to the high-pressure turbine 200 and has a shut-off valve or the like. Also in this case, it is possible to suppress occurrence of resonant vibration at the branching pipe between the steam path and the shut-off valve.

(Seventh Pipe Configuration)

Figure 16:
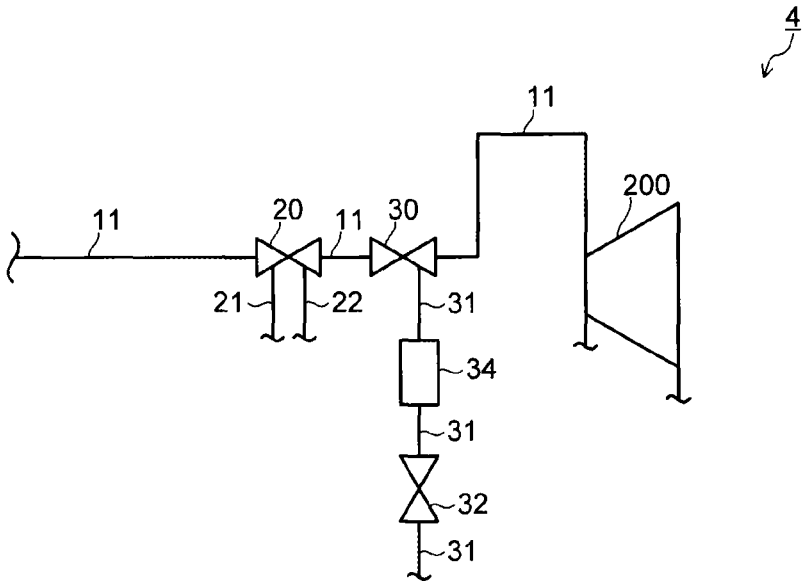
FIG. 16 is a diagram schematically illustrating a seventh pipe configuration of the post-valve drain pipe of the upper half side main steam control valve in the steam turbine pipe of the fourth embodiment.

FIG. 16 is a diagram schematically illustrating a seventh pipe configuration of the post-valve drain pipe 31 of the upper half side main steam control valve 30 in the steam turbine pipe 4 of the fourth embodiment.

The post-valve drain pipe 31 is provided with a shut-off valve 32. Further, a damping portion 34 is provided in the post-valve drain pipe 31 between the upper half side main steam control valve 30 and the shut-off valve 32 as illustrated in FIG. 16. The damping portion 34 is composed of an element that damps the resonant vibration (sympathetic vibration). The damping portion 34 has a damping element structure that damps the resonant vibration such as, for example, an orifice structure, or a resonance type muffler structure.

Provision of the damping portion 34 as described above makes it possible to damp the resonant vibration at the post-valve drain pipe 31 between the upper half side main steam control valve 30 and the shut-off valve 32. This makes it possible to suppress an abnormal increase in temperature of the post-valve drain pipe 31 even after the shut-off valve 32 is closed. Consequently, breakage of the post-valve drain pipe 31 can be prevented.

Note that the above-described configuration is not limited to be provided at the post-valve drain pipe 31. For example, the above-described configuration may be applied to a branching pipe that branches off from a steam path leading steam from the boiler to the high-pressure turbine 200 and has a shut-off valve or the like. Also in this case, it is possible to damp the resonant vibration at the branching pipe between the steam path and the shut-off valve.

Fifth Embodiment

The configurations of an upper half side main steam pipe 11 provided with an upper half side main stop valve 20 and an upper half side main steam control valve 30 and a lower half side main steam pipe 12 provided with a lower half side main stop valve 40 and a lower half side main steam control valve 50 in a steam turbine pipe 5 of a fifth embodiment are the same as those in the steam turbine pipe 1 of the first embodiment.

In the steam turbine pipe 5 of the fifth embodiment, the pipe configuration of a post-valve drain pipe 31 of the upper half side main steam control valve 30 is different from the pipe configuration of the first embodiment. Therefore, the different point will be mainly described. Note that the pipe configuration of the post-valve drain pipe 31 of the upper half side main steam control valve 30 will be described here as an example. Note that this pipe configuration is also applicable to the pipe configuration of a post-valve drain pipe 51 of the lower half side main steam control valve 50.

Figure 17:
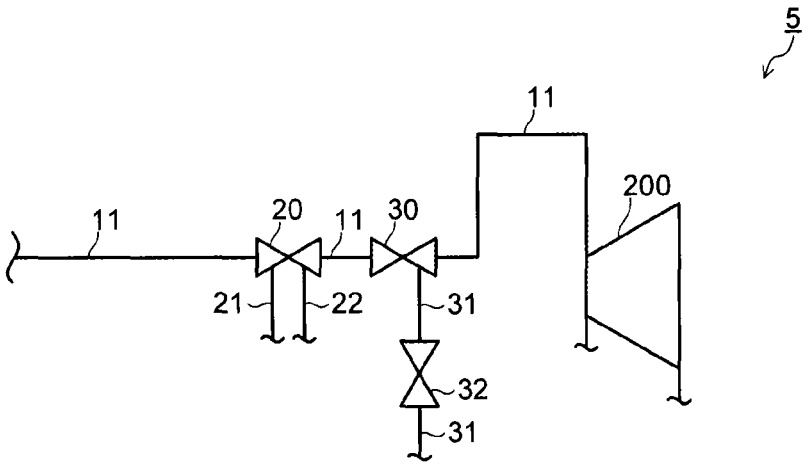
FIG. 17 is a diagram schematically illustrating a pipe configuration of a post-valve drain pipe of an upper half side main steam control valve in a steam turbine pipe of a fifth embodiment.

FIG. 17 is a diagram schematically illustrating the pipe configuration of the post-valve drain pipe 31 of the upper half side main steam control valve 30 in the steam turbine pipe 5 of the fifth embodiment.

As illustrated in FIG. 17, the post-valve drain pipe 31 is provided with a shut-off valve 32. As described above, the shut-off valve 32 is closed after completion of the warming of a high-pressure turbine 200. Increasing the load up to a rated operation of the high-pressure turbine 200 in this state sometimes abnormally increases temperature of the post-valve drain pipe 31 between the upper half side main steam control valve 30 and the shut-off valve 32.

Hence, in the fifth embodiment, the shut-off valve 32 is kept open even after the completion of the warming of the high-pressure turbine 200. Then, the shut-off valve 32 is closed at the time when the load on the high-pressure turbine 200 reaches 30% to 50%.

Here, in a state that the load on the high-pressure turbine 200 is less than 30%, the valve opening degree of the upper half side main steam control valve 30 is small. Therefore, the flow of steam passing through a gap between the valve element and the valve seat of the upper half side main steam control valve 30 is greatly disturbed. If the shut-off valve 32 is kept closed in this state, the pressure fluctuation in the post-valve drain pipe 31 between the upper half side main steam control valve 30 and the shut-off valve 32 increases, leading to an abnormal increase in temperature.

On the other hand, when the load on the high-pressure turbine 200 is 30% to 50%, the valve opening degree of the upper half side main steam control valve 30 becomes large. This decreases the disturbance of the flow of the steam passing through the gap between the valve element and the valve seat of the upper half side main steam control valve 30. Even if the shut-off valve 32 is closed in this state, the pressure fluctuation in the post-valve drain pipe 31 between the upper half side main steam control valve 30 and the shut-off valve 32 is suppressed, causing no abnormal increase in temperature.

As described above, adjustment of the timing to close the shut-off valve 32 can suppress the pressure fluctuation in the post-valve drain pipe 31 between the upper half side main steam control valve 30 and the shut-off valve 32. This makes it possible to suppress an abnormal increase in temperature of the post-valve drain pipe 31 even after the shut-off valve 32 is closed. Consequently, breakage of the post-valve drain pipe 31 can be prevented.

According to the above-described embodiments, it becomes possible to provide reliable steam turbine pipe and pipe by preventing an abnormal increase in temperature in a steam turbine pipe system.

Further, an example in which one end of the post-valve drain pipe 31 is connected to the upper half side main steam control valve 30 is illustrated in the above-described first to fifth embodiments, the post-valve drain pipe 31 is not limited to this configuration. For instance, the post-valve drain pipe 31 may be configured such that its one end is connected to the upper half side main steam pipe 11 at the immediately downstream of the upper half side main steam control valve 30. In this case, for example, in the pipe configuration illustrated in FIG. 3, the one end of the post-valve drain pipe 31 is connected on the side closer to the upper half side main steam control valve 30 than is the connecting portion of the branching pipe 60 with the upper half side main steam pipe 11.

Note that this configuration may be applied also to the post-valve drain pipe 51 on the lower half side. More specifically, the one end of the post-valve drain pipe 51 may be connected to the lower half side main steam pipe 12 at the immediately downstream of the lower half side main steam control valve 50, instead of being connected to the lower half side main steam control valve 50.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A steam turbine pipe in a steam turbine facility, comprising:

an upper half side main steam pipe that leads steam from a boiler to an upper half side of a steam turbine;

a lower half side main steam pipe that leads steam from the boiler to a lower half side of the steam turbine;

an upper half side main steam control valve that intervenes in the upper half side main steam pipe and regulates a flow rate of the steam to be led to the upper half side of the steam turbine;

a lower half side main steam control valve that intervenes in the lower half side main steam pipe and regulates a flow rate of the steam to be led to the lower half side of the steam turbine;

an upper half side drain pipe that is connected to the upper half side main steam control valve and has an open end; and wherein the open end of the upper half side drain pipe is connected to the lower half side main steam pipe between the lower half side main steam control valve and the steam turbine.

2. The steam turbine pipe according to claim 1, further comprising:

a lower half side drain pipe that is connected to the lower half side main steam control valve and leads drain to an outside; and a shut-off valve that intervenes in the lower half side drain pipe.

3. The steam turbine pipe according to claim 1, further comprising:

a lower half side drain pipe that is connected to the lower half side main steam pipe between the lower half side main steam control valve and the steam turbine and leads drain to an outside; and a shut-off valve that intervenes in the lower half side drain pipe.

4. A steam turbine pipe in a steam turbine facility, comprising:

an upper half side main steam pipe that leads steam from a boiler to an upper half side of a steam turbine;

a lower half side main steam pipe that leads steam from the boiler to a lower half side of the steam turbine;

an upper half side main steam control valve that intervenes in the upper half side main steam pipe and regulates a flow rate of the steam to be led to the upper half side of the steam turbine;

a lower half side main steam control valve that intervenes in the lower half side main steam pipe and regulates a flow rate of the steam to be led to the lower half side of the steam turbine;

an upper half side drain pipe that is connected to the upper half side main steam control valve and has an open end;

a lower half side drain pipe that is connected to the lower half side main steam control valve and leads drain to an outside; and a shut-off valve that intervenes in the lower half side drain pipe, wherein the open end of the upper half side drain pipe is connected to the lower half side drain pipe between the lower half side main steam control valve and the shut-off valve.

5. A steam turbine pipe in a steam turbine facility, comprising:

an upper half side main steam pipe that leads steam from a boiler to an upper half side of a steam turbine;

a lower half side main steam pipe that leads steam from the boiler to a lower half side of the steam turbine;

an upper half side main steam control valve that intervenes in the upper half side main steam pipe and regulates a flow rate of the steam to be led to the upper half side of the steam turbine;

a lower half side main steam control valve that intervenes in the lower half side main steam pipe and regulates a flow rate of the steam to be led to the lower half side of the steam turbine;

an upper half side drain pipe that is connected to the upper half side main steam control valve and has an open end;

a lower half side drain pipe that is connected to the lower half side main steam pipe between the lower half side main steam control valve and the steam turbine and leads drain to an outside; and a shut-off valve that intervenes in the lower half side drain pipe, wherein the open end of the upper half side drain pipe is connected to the lower half side drain pipe between the lower half side main steam pipe and the shut-off valve.

* * * * *